US006024239A

United States Patent [19]

Turner et al.

[11] Patent Number: 6,024,239

[45] Date of Patent: Feb. 15, 2000

[54] END CLOSURE WITH IMPROVED OPENABILITY

[75] Inventors: Timothy L. Turner, Cary; Randall G. Forrest, Park Ridge; Michael P. Miles, Bloomingdale, all of Ill.

[73] Assignee: American National Can Company, Chicago, Ill.

[21] Appl. No.: 08/887,576

[22] Filed: Jul. 3, 1997

[51] Int. Cl.[7] ..... B65D 17/34

[52] U.S. Cl. ..... 220/269

[58] Field of Search ..... 220/269

[56] References Cited

U.S. PATENT DOCUMENTS

| | | | |
|---|---|---|---|
| Re. 31,702 | 10/1984 | Brown . | |
| Re. 33,217 | 5/1990 | Nguyen . | |
| D. 244,915 | 7/1977 | Cudzik . | |
| D. 263,802 | 4/1982 | Fraze . | |
| D. 263,803 | 4/1982 | Fraze . | |
| D. 265,463 | 7/1982 | Hasegawa . | |
| D. 266,991 | 11/1982 | Hasagawa et al. . | |
| D. 267,393 | 12/1982 | Gruodis et al. . | |
| D. 275,373 | 9/1984 | Brown et al. . | |
| D. 279,265 | 6/1985 | Turner et al. . | |
| D. 302,116 | 7/1989 | Cassai et al. . | |
| D. 318,225 | 7/1991 | Cassai et al. . | |
| D. 319,580 | 9/1991 | Cassai et al. . | |
| D. 320,153 | 9/1991 | Cassai et al. . | |
| D. 327,424 | 6/1992 | Pierce . | |
| D. 338,156 | 8/1993 | Cook . | |
| D. 364,807 | 12/1995 | Taylor . | |
| D. 365,988 | 1/1996 | Clarke, III . | |
| D. 371,073 | 6/1996 | Taylor . | |
| 3,215,305 | 11/1965 | Frankenberg . | |
| 3,957,005 | 5/1976 | Heffner . | |
| 3,967,752 | 7/1976 | Cudzik . | |
| 3,977,561 | 8/1976 | Strobe et al. | 220/269 |
| 4,015,744 | 4/1977 | Brown . | |
| 4,024,981 | 5/1977 | Brown . | |
| 4,030,631 | 6/1977 | Brown . | |

(List continued on next page.)

FOREIGN PATENT DOCUMENTS

| | | |
|---|---|---|
| 0 103 074 | 3/1984 | European Pat. Off. . |
| 0 191 271 A2 | 8/1986 | European Pat. Off. . |
| 0 381 888 A1 | 8/1990 | European Pat. Off. . |
| 0 564 725 A1 | 10/1993 | European Pat. Off. . |
| 0 704 382 A2 | 4/1996 | European Pat. Off. . |
| 1-308744 | 12/1989 | Japan . |
| 6-24443 | 2/1994 | Japan . |
| 2067159 | 7/1981 | United Kingdom . |
| 1604068 | 12/1981 | United Kingdom . |
| 2193140 | 2/1988 | United Kingdom . |
| WO 97 29960 | 8/1997 | WIPO . |

OTHER PUBLICATIONS

InterBev '94 Show, Advertising Literature, "Reynolds Develops Large–Opening Ends," Oct. 24, 1994.

Davis, Tim, "Packaging Priorities," *Beverage World,* Dec. 1994, pp. 58, 60, 62 and 64.

*Primary Examiner*—Stephen K. Cronin
*Attorney, Agent, or Firm*—Wallenstein & Wagner, Ltd.

[57] ABSTRACT

The present invention provides a stay-on-tab end closure having a displaceable tear panel defined by a frangible score with a sloping segment and a non-frangible hinge segment. A curvilinear bead is formed entirely in an exposed area of the central panel formed by a void region of the tab webbing. The nose of the tab has a generally asymmetric shaped outer edge with a second portion extending further over the tear panel toward the curvilinear transition zone of the score. The invention further provides a tab with an asymmetrical thickness, with a thickened portion adjacent the second scoreline segment, and further provides a bead segment positioned under a side portion of the tab nose adjacent the second segment of the score. The present invention also provides an end with a hinge region of the tab adapted to bend at a hinge line, the hinge line intersecting the central longitudinal axis of the tab at an oblique angle. The invention also provides a stepped profile of the panel outer edge with substantially parallel countersink walls and a chuck wall angularly extending from below the panel height.

26 Claims, 4 Drawing Sheets

U.S. PATENT DOCUMENTS 4,031,837 6/1977 Jordan .
4,061,243 12/1977 Khoury .
4,062,471 12/1977 Perry ..... 220/269
4,084,721 4/1978 Perry .
4,109,599 8/1978 Schultz .
4,130,219 12/1978 Mallorca .
4,175,670 11/1979 Reynolds et al. .
4,184,607 1/1980 Potts .
4,205,760 6/1980 Hasegawa .
4,210,257 7/1980 Radtke .
4,211,335 7/1980 Langseder .
4,217,843 8/1980 Kraska .
4,266,688 5/1981 Reid .
4,276,993 7/1981 Hasegawa .
4,289,251 9/1981 Maliszewski ..... 220/269
4,305,523 12/1981 Dalli et al. .
4,361,251 11/1982 Langseder et al. .
4,363,419 12/1982 Walz, Sr. .
4,387,827 6/1983 Ruemer, Jr. .
4,420,283 12/1983 Post .
4,434,641 3/1984 Nguyen .
4,465,204 8/1984 Kaminski et al. .
4,516,420 5/1985 Bulso, Jr. et al. .
4,530,631 7/1985 Kaminski et al. .
4,549,424 10/1985 Bulso, Jr. et al. .
4,559,801 12/1985 Smith et al. .
4,561,280 12/1985 Bachmann et al. .
4,571,978 2/1986 Taube et al. .
4,577,774 3/1986 Nguyen .
4,606,472 8/1986 Taube et al. .
4,641,761 2/1987 Smith et al. .
4,704,887 11/1987 Bachmann et al. .
4,713,958 12/1987 Bulso, Jr. et al. .
4,716,755 1/1988 Bulso, Jr. et al. .
4,722,215 2/1988 Taube et al. .
4,733,793 3/1988 Moen .
4,735,863 4/1988 Bachmann et al. .
4,749,100 6/1988 Eberhart .
4,790,705 12/1988 Wilkinson et al. .
4,796,772 1/1989 Nguyen .
4,804,104 2/1989 Moen .
4,808,052 2/1989 Bulso, Jr. et al. .
4,832,223 5/1989 Kalenak et al. .
4,862,722 9/1989 Fraze et al. .
4,865,506 9/1989 Kaminski .
4,872,597 10/1989 Hanafusa .
4,880,136 11/1989 Englert .
4,928,844 5/1990 LaBarge .
4,930,654 6/1990 Thibeault et al. .
4,930,658 6/1990 McEldowney .
4,991,735 2/1991 Biondich .
5,011,037 4/1991 Moen et al. ..... 220/271
5,064,087 11/1991 Koch .
5,119,664 6/1992 Schubert .
5,129,541 7/1992 Voigt et al. .
5,149,238 9/1992 McEldowney et al. .
5,199,591 4/1993 Thibeault et al. .
5,287,718 2/1994 Yamanashi .
5,307,947 5/1994 Moen et al. .
5,375,729 12/1994 Schubert .
5,385,254 1/1995 Hannon .
5,405,039 4/1995 Komura .
5,456,378 10/1995 DeMars .
5,711,448 1/1998 Clarke, III ..... 220/269
5,715,964 2/1998 Turner et al. ..... 220/269

END CLOSURE WITH IMPROVED OPENABILITY

TECHNICAL FIELD OF THE INVENTION

The present invention relates to end closures for two-piece beer and beverage metal containers, having a frangible tear panel and a retained-tab secured by a rivet. More specifically, the present invention relates to improved characteristics for opening the frangible tear panel of the end.

BACKGROUND OF THE INVENTION

Typical end closures for beer and beverage containers have an opening panel and an attached leverage tab for pushing the opening panel into the container to open the end. The container is typically a drawn and ironed metal can, usually constructed from a thin plate of aluminum. End closures for such containers are also typically constructed from a cutedge of thin plate of aluminum or steel, formed into a blank end, and manufactured into a finished end by a process often referred to as end conversion. These ends are formed in the process of first forming a cutedge of thin metal, forming a blank end from the cutedge, and converting the blank into an end closure which may be seamed onto a container.

These types of container ends have been used for many years, with almost all such ends in use today being the "ecology" or "stay-on-tab" ends in which the tab remains attached to the end after the opening panel is opened. Throughout the use of such ends, manufacturers have sought to save the expense of the metal by downgauging the metal of the ends and the tabs. However, because ends are used for containers with pressurized contents, the score of the opening panel must have sufficient score residual to withstand such pressure, which in turn requires that the tab have a thickness of metal to provide strength to open the panel. Further, with the more recent popular use of large-open ends, additional problems arise with regard to openability of the ends. Because of the enlarged size of the opening panel (or tear panel), more stress is placed on the tab during opening of the tear panel, constraining efforts to further downgauge the tab. Also, the score in certain regions of the large-open tear panel are more difficult to open by the tab leveraging against the tear panel. This is especially true for the region of the score which is in the 5:00 to 6:00 clock position (with the rivet and tab nose being the 12:00 position).

Yet another problem with such ends is a slack of metal in the rivet area of the center panel resulting from the end conversion process. The slack of metal makes opening of the tear panel by the tab difficult because of the loss of necessary leverage by the tab. When the tear panel is initially severed, a very small amount of slack metal in the area around the rivet is helpful to initiate separation of the scoreline. However, the existence of any greater amount of slack causes panel lift when forcing the tab against the tear panel, thereby decreasing the efficiency and leverage of the tab.

Another problem with such container ends is corrosion of the metal of the score, the area called the score residual. This corrosion, often referred to as stress corrosion, is primarily caused by moisture build-up in the score, sensitivity of the metal, and tensile stress forces in the metal of the score area. The moisture build-up is primarily caused by water remaining on the end after a washing operation performed by a filler (such as with a beer or soft drink filling operation). Also, increased humidity resulting from elevated temperatures is especially a problem when a pallet or tray of the filled containers is wrapped in plastic shrink wrap, thereby trapping the moisture on the ends. The tensile stress state of the metal is increased by elevated temperature creating increased internal pressure of the container, thereby causing tensile stress forces in the metal of the score area.

Another problem with such container ends is the restriction to the material and cost savings when seeking to make the ends from a thinner metal stock (downgauging), primarily due to the fact that the traditional geometry of such ends requires one to make the ends from a larger cutedge of metal when attempting to make the end of thinner gauge metal.

As is explained in greater detail below, the present invention reduces or eliminates these problems with ecology type ends and the problems with the large-open ends.

SUMMARY OF THE INVENTION

It is an object of the present invention to provide an end closure for a container having a central panel wall with a product side and a public side. The end has a displaceable tear panel in the central panel wall at least substantially defined by a frangible score and a non-frangible hinge segment, and a tab attached to the public side of the central panel wall by a rivet, at least a nose portion of the tab extending over a portion of the tear panel. The tab has a lift end opposite the tab nose and a central webbing between the nose and lift end with a hinge region and a rivet island surrounding the rivet. The rivet island is at least partially surrounded by a void region to provide an exposed area of the central panel and a bead is formed entirely in the exposed area of the central panel.

It is also an object of the present invention to provide an end having a score with a first scoreline segment with a vent region positioned at least partially under the nose of the tab and extending to a region immediately adjacent the tab nose. A second curvilinear scoreline segment extends from the first segment toward the panel outer edge portion to a third scoreline segment having a curvilinear transition zone and extending to a fourth scoreline segment of the remaining scoreline. The nose of the tab has a generally asymmetric shaped outer edge with a first portion and a second portion. The second portion extends further over the tear panel toward the curvilinear transition zone than the first portion of the nose.

It is also an object of the present invention to provide and end with the nose of the tab having an asymmetrical thickness, with a first portion and a thickened second portion. The thickened second portion is adjacent the second scoreline segment.

It is further an object of the present invention to provide an end having a bead segment positioned under a side portion of the tab nose adjacent the second segment of the score. The bead segment has an upper surface for contact with the tab nose and is adapted to direct an opening force toward the transition zone of the score when an opening force is applied by lifting the tab from the lift end such that the nose is applied against the tear panel.

It is also an object of the present invention to provide an end having a tab with a central longitudinal axis and a webbing with a hinge region adapted to bend at a hinge line when a lifting force is applied to the lift end of the tab to provide a leverage force by the nose against the tear panel. The hinge line intersects the central longitudinal axis of the tab at an oblique angle.

It is yet another object of the present invention to provide a compressive stress component in the metal of the panel immediately adjacent the score. The invention provides a sloping segment of the area surrounding the score, with a first bend which leads to a first sloping edge of the tear panel adjacent the score. The sloping segment also has a second sloped edge on the panel wall outside the tear panel, immediately adjacent the score, leading away from the score to a second bend.

It is another object of the present invention to provide a geometry of the end outer peripheral area which has a stepped profile of the panel outer edge and a narrow countersink with substantially parallel walls and a chuck wall angularly extending from below the height of the panel to an outer curl.

Other advantages and aspects of the invention will become apparent upon making reference to the specification, claims, and drawings to follow.

DETAILED DESCRIPTION OF THE DRAWINGS

Figure 1:
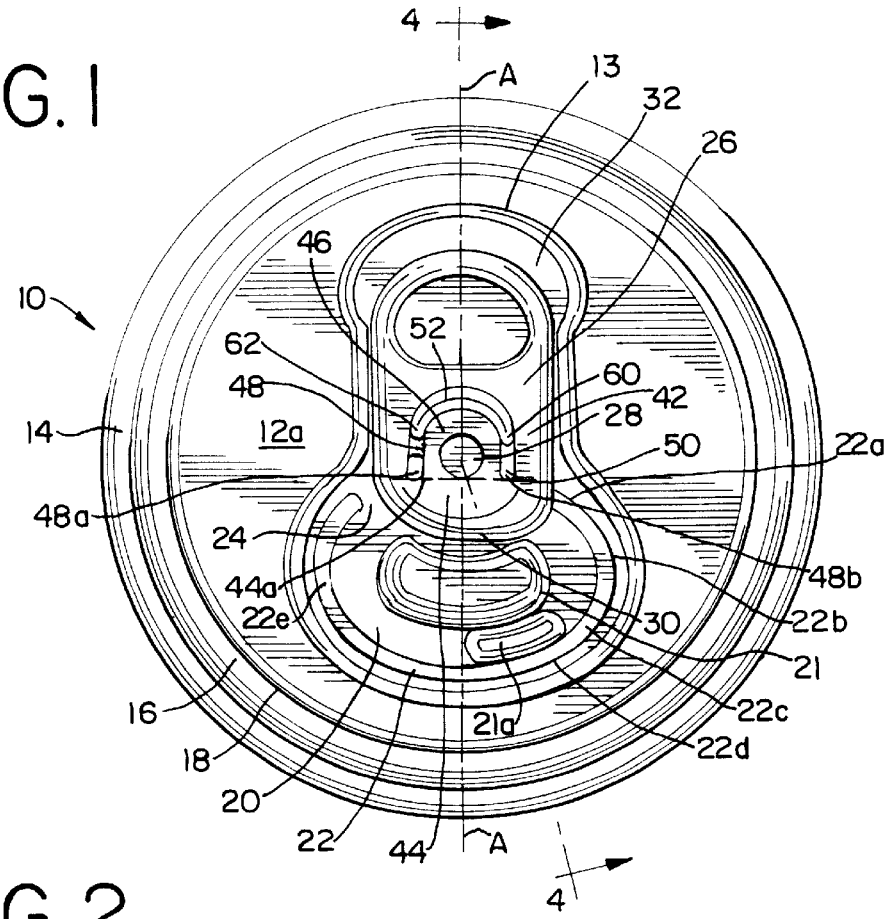
FIG. 1 is a plan view of the upper side an end closure of one embodiment of the present invention.
Figure 2:
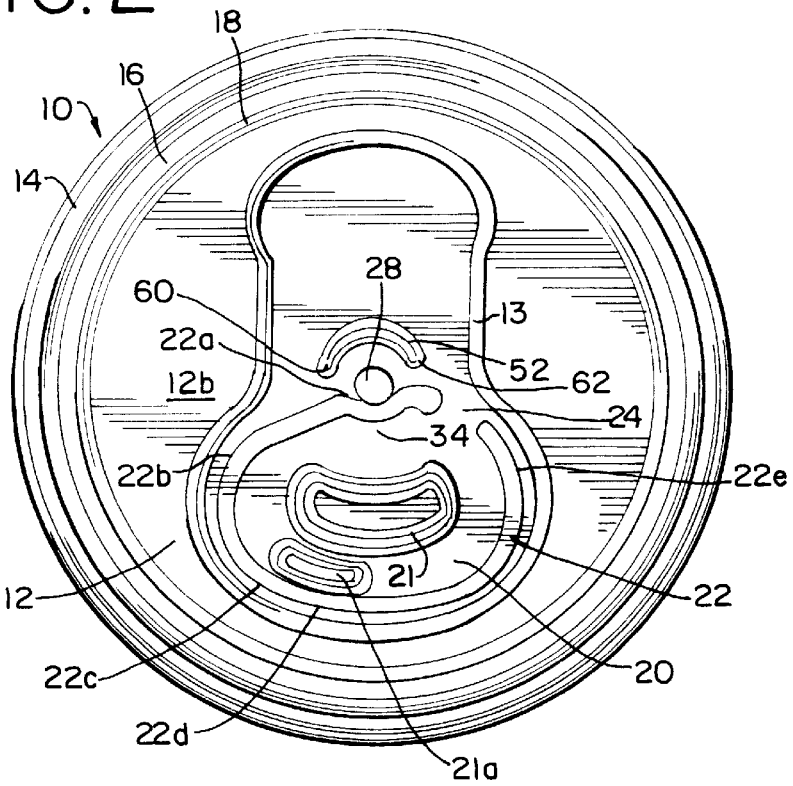
FIG. 2 is a plan view of the under side of the end of FIG. 1.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The Figures show the article of the present invention, made according to the manufacturing method of the invention. The container end of the present invention has improved opening characteristics, having structure adapted to provide a stiff center panel region around the central rivet area which serves as the leverage point for opening, and structure adapted to provide improved leverage and smooth openability for the end.

In the preferred embodiment of FIGS. 1–8, the end closure 10 for a container (not shown) has a central panel wall 12 having a seaming curl 14 for joining the wall to the container. The container is typically a drawn and ironed metal can, usually constructed from a thin plate of aluminum or steel. End closures for such containers are also typically constructed from a cutedge of thin plate of aluminum or steel, formed into blank end, and manufactured into a finished end by a process often referred to as end conversion. In the embodiment shown in the Figures, the central panel is joined to a container by a seaming curl 14 which is joined to a mating curl of the container. The seaming curl 14 of the end closure 10 is integral with the central panel 12 by a countersink area 16 which is joined to the panel outer edge 18 of the central panel 12. This type of means for joining the central panel 12 to a container is presently the typical means for joining used in the industry, and the structure described above is formed in the process of forming the blank end from a cutedge of metal plate, prior to the end conversion process. However, other means for joining the central panel to a container may be employed with the present invention.

The steps of manufacturing the end begin with blanking the cutedge, typically a round or non-round cutedge of thin metal plate. Examples of non-round cutedge blanks include elliptical cutedges, and convoluted cutedges. A convoluted cutedge may be described as generally having three distinct diameters, each diameter being 45° relative to the others. The cutedge is then formed into a blank end by forming the seaming curl, countersink, panel radius and the central panel.

The conversion process for this type of end closure includes the following steps: forming a rivet by first forming a projecting bubble in the center of the panel and subsequently working the metal of the bubble into a button and into the more narrow projection of metal being the rivet; forming the tear panel by scoring the metal of the panel wall; forming an inner bead on the tear panel; forming a deboss panel by bending the metal of the panel wall such that a central area of the panel wall is slightly lower than the remaining panel wall; staking the tab to the rivet; and other subsequent operations such as wipe-down steps to remove sharp edges of the tab, lettering on the panel wall by scoring or embossing (or debossing), and restriking the rivet island. This conversion process is further described below with description of the structure of the end closure.

The central panel wall 12 has a displaceable tear panel 20 defined by a frangible score 22 and a non-frangible hinge segment 24. The tear panel 20 of the central panel 12 may be opened, that is the frangible score 22 may be severed and the tear panel 20 displaced at an angular orientation relative to the remaining portion of the central panel 12, while the tear panel 20 remains hingeably connected to the central panel 12 through the hinge segment 24. In this opening operation, the tear panel 20 is displaced at an angular deflection. More specifically, the tear panel 20 is deflected at an angle relative to the plane of the panel 12, with the vortex of the angular displacement being the hinge segment 24.

The tear panel 20 is formed during the conversion process by a scoring operation. The tools for scoring the tear panel 20 in the central panel 12 include an upper die on the public side 12*a* having a scoring knife edge in the shape of the tear panel 20, and a lower die on the product side 12*b* to support the metal in the regions being scored. When the upper and lower die are brought together, the metal of the panel wall 12 is scored between the dies. This results in the scoring knife edge being embedded into the metal of the panel wall 12, forming the score which appears as a wedge-shaped recess in the metal. The metal remaining below the wedge-shaped recess is the residual 23 of the score 22. Therefore, the score is formed by the scoring knife edge causing movement of metal, such that the imprint of the scoring knife edge is made in the public side 12*a* of the panel wall 12. This movement of metal results in excess metal in the panel wall 12, causing a slack of loose excess metal, a condition well known in the art and which is undesirable.

An inner tear panel bead 21 may also be formed in the tear panel 20. The inner bead may be used to remove the excess metal, or slack, in the tear panel 20 to stiffen the tear panel 20. The inner bead also adds a structural beam-like component in the tear panel 20 to further stiffen a region of the tear panel 20 and provide better leverage for opening the score in that region of the tear panel 20. The inner bead 21 is formed as a standard bead as used in the end-manufacturing industry; that is, a bend of the metal made between mating dies. Preferably, formation of the tear panel bead 21 does not include any thinning of the metal, as the metal is bent into the bead shape rather than the metal being squeezed or coined. The tear panel bead 21 is preferably formed in a shape which generally follows the geometric shape of the score 22 of the tear panel 20, thereby evenly drawing slack metal from the tear panel 20. A supplemental bead 21*a* is preferably formed adjacent the transition zone 22*d* of the tear panel 20, which is a curvilinear segment of the score 22 distal from the nose of the tab and close to the outer edge 18 of the panel wall 12. The supplemental bead 21*a* provides a structural beam component adjacent the transition zone 22*d* of the tear panel score 22 which, during opening of the tear panel 20, helps to lower the opening force ("push force") required to sever the score in the transition zone 22*d*.

The opening of the tear panel 20 is operated by the tab 26 which is attached to the central panel 12 by a rivet 28. The tab 26 is attached to the central panel 12 such that the nose 30 of the tab 26 extends over a proximal portion of the tear panel 20. The lift end 32 of the tab 26 is located opposite the tab nose 30 and provides access for a user to lift the lift end 32, such as with the user's finger, to force the nose 30 against the proximal portion of the tear panel 20.

The score 22 has a first segment 22*a* at least partially positioned under the tab nose 30 and having a vent region 34 which is the portion of the score 22 which initially fractures during opening. The score 22 further has a curvilinear second segment 22*b* extending from the first segment 22*a* toward the outer peripheral edge 18 of the panel and leading to a curvilinear third segment 22*c* with a transition zone, generally indicated as 22*d*. A fourth segment 22*e* continues from the third segment 22*c* throughout the remainder of the score 22, and terminates adjacent the hinge segment 24. During opening of the tear panel 20, therefore, the score 22 initially ruptures (i.e. the score residual 23 being severed) in the vent region 34 of the first score segment 22*a*, and the rupture of the score 22 propagates in sequence through the second segment 22*b*, the third segment 22*c*, and finally through the fourth segment 22*e*. The transition zone 22*d* of the score 22 is one region of the tear panel score 22 which exhibits a relatively large resistance to opening force, at least partly due to the curvilinear geometry of the segment 22*c*, and due to the fact that the tab nose contacts the tear panel at a distance from the transition zone 22*d*.

When the tab nose 30 is forced against the tear panel 20, the score 22 initially ruptures at the vent region 34 of the score 22 of the tear panel 20. This initial rupture of the score 22 is primarily caused by the lifting force on the tab resulting in lifting of a central region of the center panel, immediately adjacent the rivet 28, which causes separation of the residual metal of the score 22. The force required to rupture the score in the vent region 34, typically referred to as the "pop" force, is a lower degree of force relative to the force required to propagate other regions of the score 22 by continued lifting of the lift end 32 of the tab 26. Therefore, it is preferable for the panel 12 in the area around the rivet 28 only lifts enough to assist with initial score rupture, or "pop," and remains substantially stiff and flat to provide the needed leverage for the tab 26 to propagate the scoreline of the tear panel 20. The present invention provides such optimal stiffness in the center panel, as is explained further below.

After the initial "pop", or venting of the tear panel, the user continues to lift the lift end 32 of the tab 26 which causes the tab nose 30 to be pushed downward on the tear panel 20 to continue the rupture of the score 22, as an opening force. As the opening operation is continued, the tear panel 20 is displaced downward and is rotated about the hinge region 44 to be deflected into the container. During this continued score fracture propagation, the transition zone 22*d* exhibits a relatively high degree of resistance, requiring a great amount of leverage and opening force.

In the case of an end having a tear panel 20 substantially wider than the tab, such as the large-open end shown in FIG. 1, the fracturing of the score is especially difficult, especially in the transition zone, at approximately the 5:00 to 6:00 clock position (with the score immediately adjacent the rivet 28 being the 12:00 clock position). The force needed to fracture the remainder of the third segment 22*c* and the fourth segment 22*e* is relatively much less, which can result in the tear panel 20 being suddenly forced into the container, potentially resulting in the tear panel 20 slapping against the product within the container. This slapping of the product (such as beer or beverage) potentially results in product shooting out of the tear panel opening, an undesirable condition referred to as spit or splash of product. Also, as the industry continually seeks to downgauge the metal of the end and the tab (i.e., use thinner gauge to save material costs), increased efficiency in opening by the tab permits the use of a tab made of thinner and/or less metal.

To provide the best openability of the tear panel 20 from the initial pop of the vent region, and to provide smooth opening throughout the extent of the scoreline, the present invention provides stiffness with minimal lift of the central panel 12 in the region of the rivet 28, which serves as the fulcrum point for the lifting of the tab 26. Also, the present invention provides more efficient leverage by the tab during opening of the tear panel 20, adapted to direct the nose of the tab to leverage the opening force against optimal regions of the tear panel 20 for fracturing the scoreline.

Figure 3:
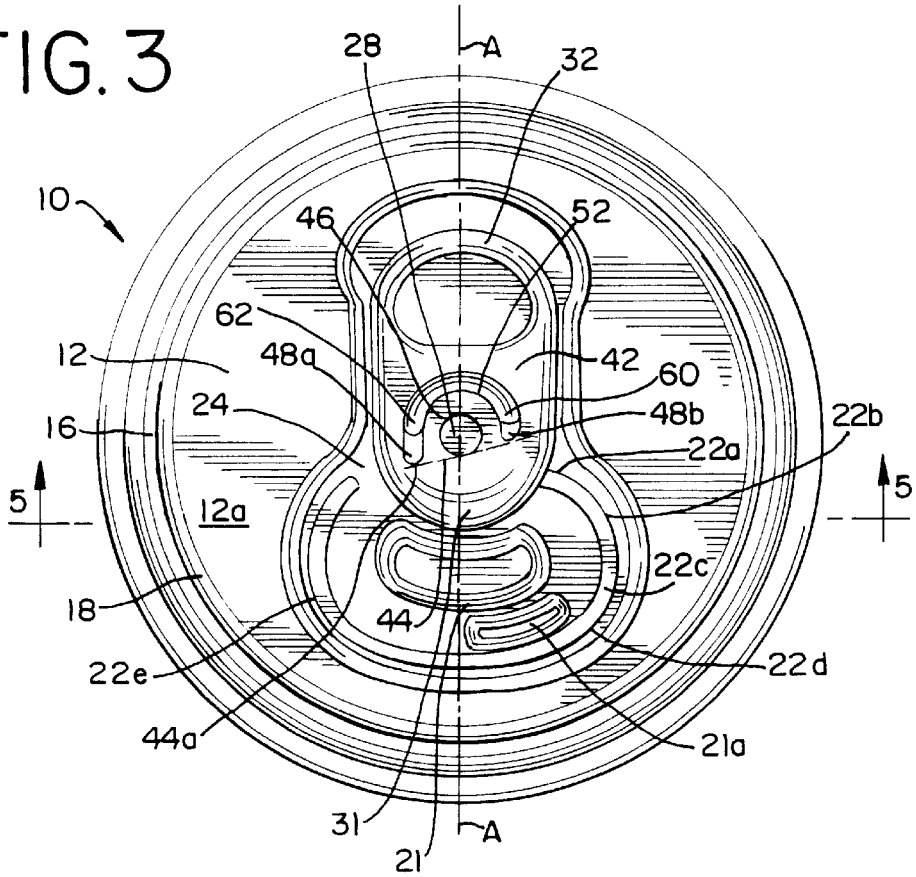
FIG. 3 is a plan view of the upper side an alternative end closure of the present invention.
Figure 4:
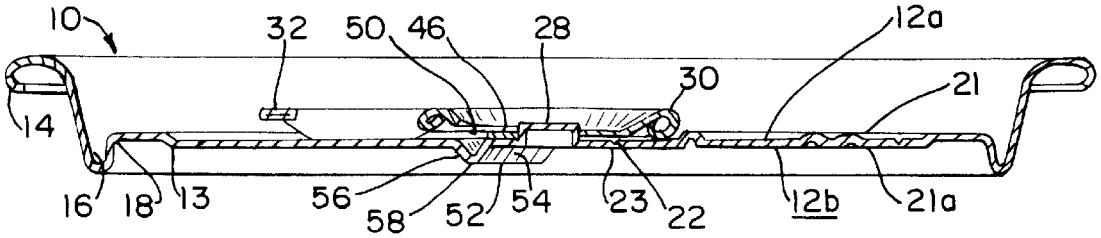
FIG. 4 is a cross-sectional view along line 4—4 of FIG. 1.

As is best shown in FIGS. 1 and 3, the tab 26 has a central webbing 42 located between the nose 30 and the lift end 32. The central webbing 42 includes a hinge region 44 and a rivet island 46 surrounding the rivet 28. A void region 48 of the tab webbing 42 provides an exposed area 50 of the central panel 12. The void region 48 has a curvilinear geometry which borders the rivet island 46 and at least partially surrounds the rivet 28, with a first end 48*a* of the void region 48 being disposed generally to one side of the rivet 28, and a second end 48*b* being generally disposed on an opposite side of the rivet 28. The hinge region 44 of the tab webbing 42 includes a hinge line 44*a* which is defined by a substantially straight line passing between the first end 48*a* and the second end 48*b* of the void region 48.

The tab 26 has a generally elongated body with a central longitudinal axis A—A defined by a central cross section through the tab nose 30, and through the central webbing 42 and the lift end 32. Typical prior art container ends often have a tab 26 which is staked in the final steps of the conversion process by staking the area of the panel wall 12 adjacent and under the rivet island 46 at an angle, to bias the tab 26 such that the lift end of the tab 26 rests close to the panel wall 12. Also, typical prior art container ends have a hinge line that is substantially perpendicular to the central longitudinal axis A—A of the tab 26. Accordingly, during opening of such a prior art end, the tab nose contacts the tear panel 20 in the area identified as 36 in FIG. 7.

Figure 7:
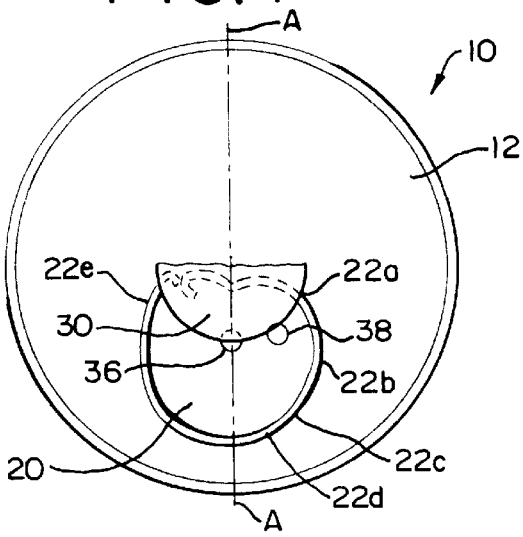
FIG. 7 is a schematic plan view of the end depicted in FIG. 3.

According to one aspect of the present invention, as shown in FIGS. 3 and 7, the hinge region 44 of the tab is adapted to have a hinge line 44*a* which is not perpendicular to the central longitudinal axis of the tab 26. Rather, the hinge line 44*a* intersects the central longitudinal axis A—A at an oblique angle. As shown in FIG. 3, one embodiment of the present invention has a void region 48 with a first end 48*a* which is closer to the outer edge 31 of the tab nose 30, and closer to the tear panel 20, than the second end 48*b*. Thus, the hinge line 44*a* of the tab 26 is oriented at an oblique angle relative to the central longitudinal axis A—A, as it is neither parallel nor perpendicular to the axis A—A.

The alteration of the hinge line 44*a* orientation relative to the central axis of the tab 26, as described above, results in a structure which directs the path of the tab 26 during opening of the tear panel 20, caused by lifting force on the lift end 32 to rotate the tab 26 about the hinge line 44*a* and cause angular displacement of the tab body.

When the consumer opens the container end 10 by lifting the lift end 32 of the tab 26 of the end shown in FIG. 3, the tab webbing 42 bends along the hinge line 44*a*, which results in the hinge line 44*a* being a fulcrum line of the tab angular displacement. Because the hinge line 44*a* is at an oblique angle relative to the tab central longitudinal axis A—A, the rotational path of the tab being lifted and the respective downward path of the tab nose 30 is likewise at an oblique angle relative to the longitudinal axis, as it is not in alignment with or parallel to the central longitudinal axis A—A. In this manner, the nose 30 of the tab 26 is deflected downward toward the tear panel 20 at an angle relative to the central panel, such that the nose 30 of the tab 26 contacts the tear panel 20 at a point to the side of the central longitudinal axis, generally identified as 38 in FIG. 7. Preferably, the initial contact point of the tab nose 30 is on the side of the tear panel 20 toward the direction of the score propagation; that is, the side closest to the region of the scoreline which propagates immediately after the initial rupture of the score.

For example, as shown in FIGS. 3 and 7, having the hinge line 44*a* of the tab at an oblique angle relative to the longitudinal axis of the tab directs the tab at an angle, such that the initial contact point of the nose 30 is to the side of the nose adjacent the second segment 22*b*, generally at 38. After initial pop of the score, the lifting force is continued and the score fracture propagates, such that the tab continues to deflect at an angle, maintaining the contact point and leverage of the nose 30 generally to the region of the tear panel 20 of continued score propagation.

This structure provides improved leverage for the score fracture by directing the opening force on the tear panel 20 to the region adjacent the scoreline fracture. Further, as described above, the transition zone 22*d* of the score 22 is one region of the tear panel score 22 which exhibits a relatively large resistance to opening force, at least partly due to the curvilinear geometry of the transition segment 22*d*. Having the oblique angle of the hinge line 44*a*, the tab is adapted to provide contact by the tab nose 30 in the region of the tear panel 20 which is proximate to the transition zone 22*d*, thereby providing better leverage by the tab and smooth fracturing of the score.

Figure 5:
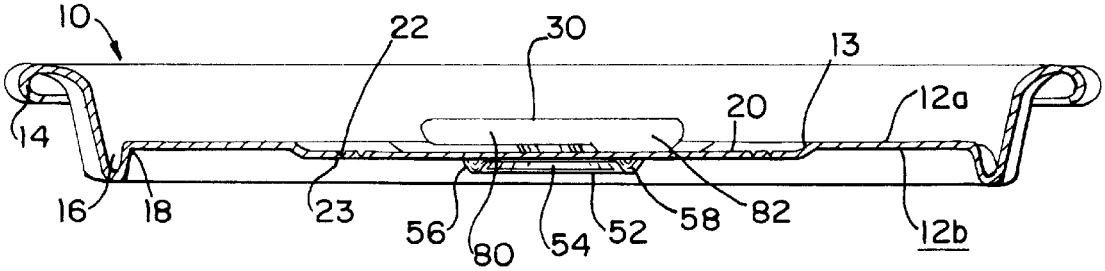
FIG. 5 is a cross-sectional view along 5—5 of FIG. 3.
Figure 6:
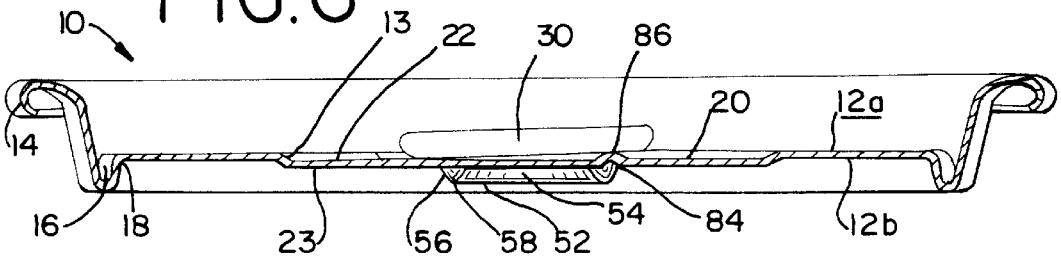
FIG. 6 is an alternative embodiment of a cross-sectional view along 5—5 of FIG. 3.
Figure 8:
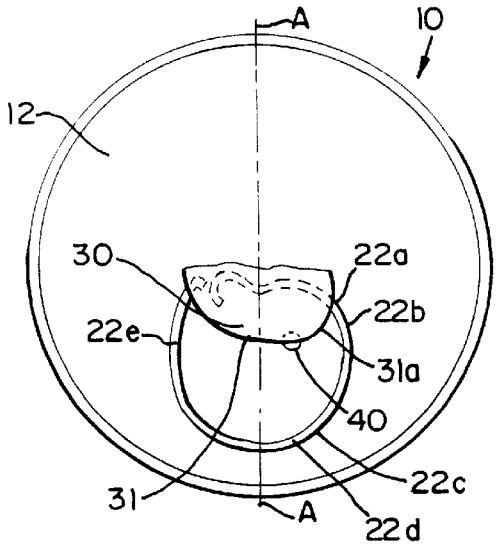
FIG. 8 is a schematic plan view of the end shown in FIG. 1.

Another aspect of the present invention improves openability with a structural component positioned between the nose of the tab and the tear panel 20 in the area adjacent the second scoreline segment 22*b*. One embodiment has a thickened portion 82 of the tab nose 30 adjacent the second scoreline segment 22*b*, as is best shown in FIG. 5. An alternative embodiment has a raised bead 84 or dimple on the tear panel 20 adjacent the second scoreline segment 22*b* under the tab nose 30, as is best shown in FIG. 6. Yet another embodiment has an asymmetrical shaped outer edge 31 of the tab nose 30, with portion 31*a* extending further over the tear panel 20 toward the second and third scoreline segments, 22*b* and 22*c*, as is best shown in FIGS. 1 and 8. All of these embodiments provide improved openability of the tear panel 20, adapted to provide directed contact of the tab nose 30 on a portion of the tear panel 20 adjacent the second scoreline segment 22*b* and to provide improved opening leverage on the tear panel 20 in the transition zone 22*d* of the third scoreline segment 22*c*.

With regard to the embodiment shown in FIG. 5, the tab nose 30 has a first portion 80 and an adjacent second portion 82 which has a thickness greater than the first portion 80. The thickened second portion 82 is positioned adjacent the second scoreline segment 22*b*, thereby being closer to the second and third scoreline segments, 22*b* and 22*c*, than the nose first portion 80. When the user applies a lifting force on the lift end of the tab, the thickened second portion 82 initially contacts the tear panel 20 adjacent the second scoreline segment 22*b*, generally in the area identified as 38 in FIG. 7. After initial pop of the score, the user continues to lift the lift end, such that the thickened portion 82 maintains contact with the tear panel 20 and provides leverage on the tear panel 20 proximal to the transition zone 22*d* of the third scoreline segment 22*c*. As the end is further opened by the user, the thickened portion 82 gradually no longer is in contact with the tear panel 20, as the first portion 80 of the nose 30 maintains contact through the remainder of the opening operation, as the fourth scoreline segment 22*e* is fracture and the tear panel 20 is angularly deflected into the container.

With regard to the embodiment shown in FIG. 6, a raised bead 84 is positioned on the tear panel 20 under the tab nose 30 and adjacent the second scoreline segment 22*b*. Similar to the embodiment described above which provided an asymmetrical thickening of the nose 30 to direct the contact between the nose 30 and the tear panel 20 (FIG. 5), the raised bead 84 shown in FIG. 6 provides an asymmetrical height of the tear panel 20 under the nose 30. The raised bead 84 is preferably a small area of metal under the side of the tab nose 30, formed by bending metal to project as a land 86 on the consumer side. The land 86 thereby is adapted to provide a raised surface such that, when the user applies a lifting force on the lift end of the tab, the nose 30 is leveraged heavily against the tear panel 20 immediately adjacent the second scoreline segment 22*b*, generally located in the position identified as 38 in FIG. 7. After initial pop of the score, the user continues to lift the lift end such that the nose 30 maintains contact with the raised bead 84 to provide heavy leverage on the tear panel 20 proximal to the transition zone of the third scoreline segment 22*c*. As the end is further opened by the user, the nose 30 gradually no longer is in contact with the bead 84, as the nose 30 maintains contact with the tear panel 20 through the remainder of the opening operation, causing fracture of the fourth scoreline segment 22*e* and angular deflection of the tear panel 20 into the container.

With regard to the embodiment shown in FIG. 1, the tab nose 30 has an asymmetrical outer edge 31 having an extended area 31*a* of the nose 30 adjacent the second scoreline segment 22*b* and projecting toward the transition zone 22*d* of the third scoreline segment 22*c*. As depicted in FIG. 8, when the user applies a lifting force on the lift end of the tab, the extended edge 31*a* of the nose 30 primarily contacts the tear panel 20 immediately adjacent the second scoreline segment 22*b*, in the area identified as 40 in FIG. 8. After initial pop of the score, and as the tear panel 20 is deflected angularly downward, the extended area 31*a* of the outer edge 31 of the tab nose 30 maintains contact with the tear panel 20 in the area adjacent the second and third scoreline segments to provide leverage adjacent the transition zone of the score.

According to another aspect of the present invention, a curvilinear bead 52 is formed in the exposed area 50 of the central panel 12. The bead 52 in the exposed area 50 is preferably formed to have a curvilinear length, adapted to at least partially surround the rivet island 46, thereby partially surrounding the rivet 28. Further, the bead 52 is preferably a deboss bead, as a recess in the public side and extending downward from the product side of the central wall 12. Although it is also possible for the bead 52 to be formed in the opposite direction to be an emboss bead which protrudes from the public side of the panel, such an emboss bead must be kept entirely within the confines of the void region 48 of the tab webbing to avoid end sponginess or end stacking problems due to the tab being raised by the emboss bead.

The bead 52 is formed entirely in the exposed area 50 of the central panel 12, such that the bead is formed in the final stages of the conversion process, after the tab 26 is attached to the end 10 by being staked onto the rivet 28. Forming the bead in the final steps of the conversion process, after scoring and staking the tab to the rivet 28 provides optimization of drawing loose metal in the region around the rivet 28, such as loose metal resulting from the steps of the conversion process, including tear panel scoring, rivet formation, or staking of the tab to the rivet. Also, having the bead formation in the final stages of the conversion process, after scoring and attaching the tab, has the benefit of allowing to practice this aspect of the present invention without costly tooling changes to add the bead formation tools with existing tooling, and permits the manufacturer to easily retrofit this manufacturing step to the existing conversion process. Although the preferred embodiment of this bead 52 is a continual curvilinear or "horse shoe" shaped bead, it should be observed that this bead 52 may be also formed as a larger bead area or as a series of dimple beads which combine to at least partially surround the rivet 28 and rivet island 46.

The bead 52 provides the desirable stiffness of the central panel 12 in the region around the rivet 28, thereby reducing the amount of panel lift resulting from the force of the tab 26 on the tear panel 20 during opening. The stiffness of the tear panel 20 is primarily provided by the bead 52 being formed as a bead of drawn metal in the exposed area 50 of the central panel 12 immediately adjacent the rivet 28 and the rivet island 46. The bead 52 has a first generally upstanding wall 54 and a second generally upstanding wall 56, joined by a transition bend 58. The first and second upstanding walls of the bead 52 are of generally the same height. Therefore, the panel wall 12 under the rivet island 46 and the rivet 28 itself are not at an angle relative to the remainder of the panel wall 12, and are positioned generally on the same plane defined by the panel wall 12. This aspect of the bead is distinct form the prior art ends which are subjected to a staking operation which causes coining of metal and a small bend in the panel area outside the rivet island 46, resulting in a slope in the metal of the area around and under the rivet island 46 relative to the plane defined by the panel wall 12.

The bead 52 preferably has an arcuate length and is positioned to partially surround the rivet 28, just outside the rivet island 46 of the tab 26 and generally opposite the tear panel 20. The ends of the arcuate bead 52 have a first leg 60 and a second leg 62. Preferably, the first leg 60 and the second leg 62 end at equal distances from the score 22.

Preferably, there is no thinning of the metal during formation of the bead 52, and the bead 52 is instead created by forming, or drawing, the metal between two opposed dies. The bead formation thereby draws available loose metal in the region, such as loose metal caused by scoring, coining of the metal while forming the rivet 28, or coining of metal while staking the tab. The bead 52 also serves as a stiffening beam in the panel 12 wall immediately adjacent the rivet 28 and rivet island 46 in the void region 48. By drawing loose metal and providing a stiffening beam, the bead 52 is adapted to provide stiffness in the panel wall 12 around the rivet island 46 to decrease the panel lift and enhance the leverage by the tab during opening of the end tear panel 20.

Figure 9:
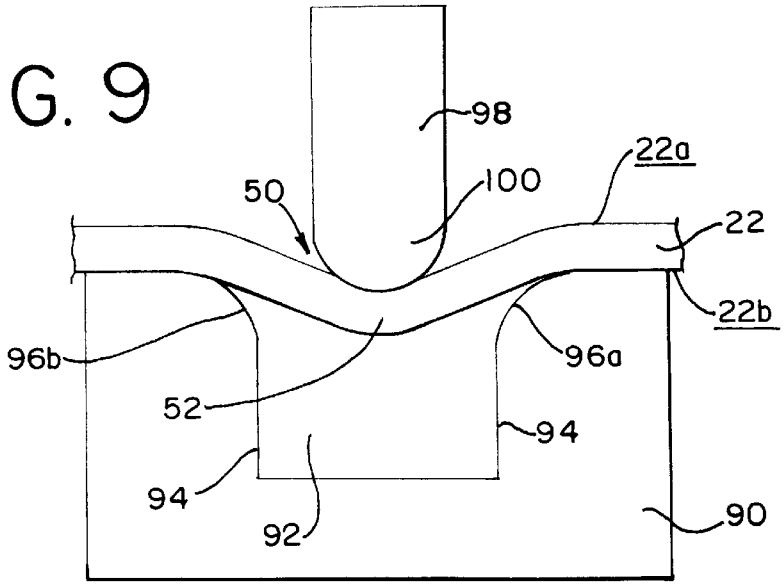
FIG. 9 is a cross sectional view of the tooling and the method of forming the void area bead shown in FIG. 1.

The step of forming the bead 52 preferably utilizes tooling as shown in FIG. 9. The lower supporting die 90 has a recess 92 with upstanding walls 94, each having rounded upper edges 96*a* and 96*b* with a radius of curvature. The upper die 98 has a protruding punch 100 with a width less than the width of the recess 92 of the lower die 90. The metal of the exposed area 50 of the panel wall 12 is positioned between the upper and lower dies 90, 98, such that the product side 12*b* of the panel wall 12 is substantially supported by the lower die 90, and the punch 100 is adjacent the public side 12*a* of the panel wall 12. The upper and lower dies 90, 98 are then brought together such that the punch 100 draws the metal in the exposed area 50 into the recess 92 of the lower die 90, and the metal of the exposed area 50 is bent over the rounded edge 96 of the upstanding walls 94 of the lower die 90, to form a bead 52 in the area 50. Preferably, the punch 100 has a width of approximately 0.020 to 0.040 inch, and the depth of progressing the punch 100 into the recess of the lower die is approximately 0.005 to 0.015 inch.

Figure 10:
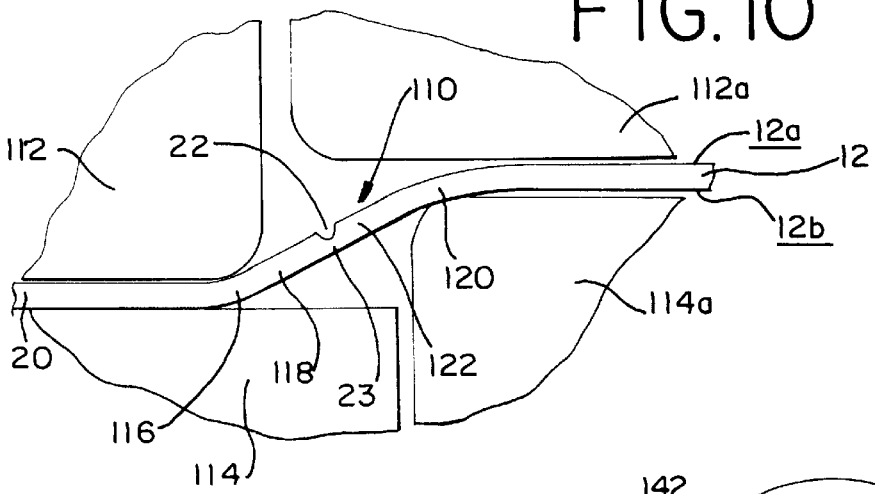
FIG. 10 is a cross sectional view of the structure, and the tooling for the forming, of the sloping segment of the score area.

Another aspect of the present invention provides a score which is resistant to environmental factors causing stress corrosion, with smooth scoreline fracturing and consistent openability. According to this aspect of the invention, the panel wall 12 has a sloping segment 110 in the area bordering each side of the score 22. As is best shown in FIG. 10, the sloping segment 110 is preferably a downward slope, such that the tear panel 20 is slightly lower than the remainder of the panel wall 12. FIG. 10 is a cross-sectional view depicting not only the structure of this aspect of the invention, but also shows the method of making this structure between upper dies 112, 112*a* and lower dies 114, 114*a*. As the upper dies 112, 112*a* are brought toward the lower dies 114, 114*a*, the metal of the panel wall 12 around the score 22 is bent to form the sloping segment 110, with the score 22 being within the slope of metal. The embodiment shown in FIG. 10 has a single scoreline 22, however, the principles of this aspect of the present invention may also be used for a typical double score having an anti-fracture score, utilizing a single sloping segment 110, or multiple or stepped sloping segments. This process of forming the sloping segment 110 in the area of the score 22 is preferably performed immediately after the scoring operation of the conversion process, but may also be incorporated into the scoring operation or adapted to be formed prior to the scoring operation. In any event, this step is preferably performed prior to staking the tab to the end so that the entire scoreline may be drawn into forming the sloping segment 110. Also, it should be appreciated that the multiple lower dies 114, 114*a* and multiple upper dies 112, 112*a* are adapted to easily be independently adjusted relative to the others, such as by the use of shims under the dies. This arrangement allows for the manufacturer to adjust the tools such that the sloping section 110 is formed with enough of a slope to assist with stress corrosion, yet not too much slope to strain or partially fracture the score residual 23. Alternatively, the tools used to form the sloping section 110 may have sloped surfaces (not shown) which generally follow the slope of the sloping section 110 to support the metal in that region.

The sloping segment 110 has an upward first bend 116 leading to a first sloped edge 118 on the outer periphery of the tear panel 20 immediately adjacent the scoreline 22. A second sloped edge 122 on the panel wall 12 immediately outside the tear panel 20 extends outward from the score to a second bend 120. As is described further below, this structure permits consistent openability and is adapted to provide missiling prevention during opening, and to provide resistance to stress corrosion in the score 22.

Stress corrosion is a type of end failure which results in corrosion of the score, primarily due to the combination of moisture build-up in the score, sensitivity of the metal to corrosion, and tensile stress state of the metal in the area of the score 22. The problem of moisture in the score is primarily due to water remaining on the end after a filled container is washed by the beverage filler. Also, such moisture may be trapped in the environment around the ends when a filler uses plastic shrink wrap covering pallets or cases of filled containers. When the environmental temperature rises within the plastic shrink wrap and within the score of the ends of the filled containers. Metal sensitivity is an inherent problem with container ends, which are typically made of aluminum metal.

The tensile stress forces of the metal in the region of the score 22 is caused by internal pressure of the container which is increased by elevated temperatures resulting in increased pressure of the contents of the containers, typically carbonated beverage. Such tensile stress forces are biaxial in the plane of the panel of metal, and result in tensile stress forces perpendicular to the score 22, thereby being a force which effectively pulls the score apart. The sloping segment 110 of the panel wall 12 reduces the stress corrosion by generating a compressive stress component in the plane of the center panel 12 of metal, thereby offsetting the tensile stress forces described above. Therefore, potential stress corrosion is avoided or diminished by the sloping segment 110 providing a compressive stress component in the metal which offsets the tensile forces perpendicular to the score.

The anti-missiling structure formed by this aspect of the invention is primarily due to the first sloped edge 118 being positioned slightly under the second edge 122 when the tear panel 20 is fractured during opening. More specifically, when the tear panel 20 initially opens by the pop or venting of the panel 20, a condition known as missiling may occur. Because of the pressure caused by the contents of the container, the tear panel 20 may missile by moving above the remaining panel wall 12 during venting, and the internal pressure then causing the continued fracture of the score as the tear panel missiles upward. By having the first sloped edge 118 (the outer edge of the tear panel 20) move slightly under the second sloped edge 122 (outside the tear panel 20), the tear panel 20 is restricted from moving above the panel wall 12, thereby preventing missiling.

Figure 11:
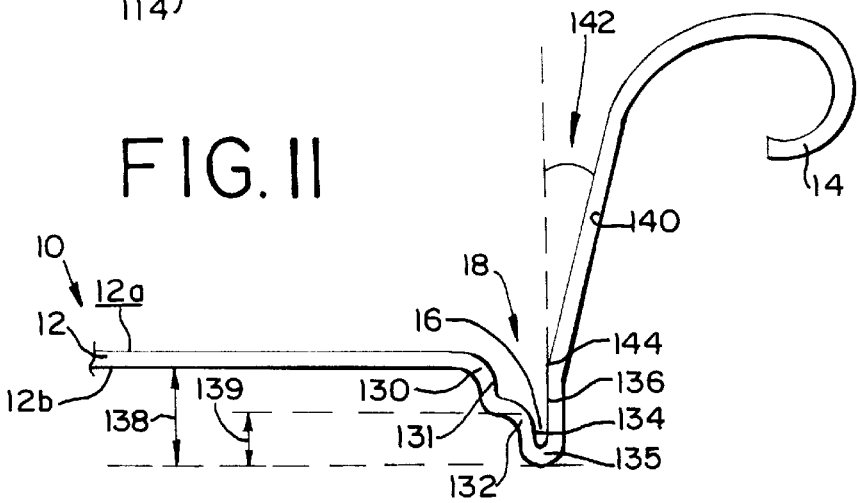
FIG. 11 is a partial cross sectional view of the outer peripheral area of the container end showing the stepped outer panel radius and narrow countersink area.

According to another aspect of the present invention, shown in FIG. 11, the panel outer edge 18 of the central panel 12 has a stepped profile with a first (upper) bend 130 and a second (lower) bend 132 cascading down to the countersink area 16. The countersink area is narrow, with opposed walls of the countersink area, an inner wall 134 and an outer wall, being substantially parallel to one another. The outer wall 136 is connected to the chuckwall 140, which extends from a crease 144 in the outer wall 136 at an outward angle 142.

The end of this configuration has an outer diameter 146 as measured to the outer edge of the curl 14. The curl 14 must be positioned such that the end 10 may be seamed onto a container, preferably within the parameters established and practiced in the industry. Accordingly, one important benefit of the embodiment shown in FIG. 11 is that the end geometry is adapted to provide proper positioning of the curl 14, primarily due to the stepped outer edge 18 and the narrow countersink 16 with substantially straight and parallel walls 134, 136. This is especially important when one seeks to make an end of thinner gauge metal, wherein traditional end geometry of such a downgauged end often requires a larger cutedge which defeats the purpose of seeking to downgauge. Also, the geometry of this aspect of the invention permits downgauging of the metal while maintaining the necessary resistance to buckle failure.

As an example of this aspect of the present invention, with a 0.0080 inch gauge aluminum end intended to comply with acceptable industry standard measurements as a 202 end (i.e., being characterized as 2 inch and 2/16 in diameter), the end 10 has an outer diameter in the range of 2.330 to 2.350 inch, and a panel diameter (i.e., the diameter measured from the vertical tangent of the inside radii of bend 130) of approximately 1.845 to 1.855 inch. The upper bend 130 of the panel outer edge 18 has an inside radius of curvature approximately 0.015 inch, and the lower bend 132 of the panel outer edge 18 has an inside radius of curvature of approximately 0.012 inch. A generally vertical transition segment 131 passes between the first bend 130 and the second bend 132. The inner wall 134 of the countersink area 16 has an inner wall height, defined by the height 139 of the second bend 132, of approximately 0.040 inch, which is approximately half the height 138 of the panel wall 12, the panel wall height preferably being in the range of 0.075 to 0.085 inch. The outer wall 136 has a height below the height 138 of the panel 12, and preferably less than 0.050 inch. The countersink 16 has a curved segment 135 joining the inner wall 134 to the outer wall 136. The curved segment 135 preferably has a radius of curvature of less than 0.005 inch, with the inner and outer walls 134, 136 being substantially parallel, and both being aligned substantially perpendicular to the central panel 12.

The angle 142 of the chuck wall 140 is preferably in the range of 10° to 15° relative to the outer wall 136, extending substantially straight from the crease 144 at the juncture between the outer wall 136 of the countersink 16 and the chuckwall 140. As described above, the height of the outer wall 136 is preferably below the height of the plane defined by the panel 12. Therefore, the crease 144 preferably is positioned at or below the height of the first bend 130 of the outer edge 18. While this example demonstrates the geometry of this embodiment of the present invention used on a 202 size end, it should be appreciated that this structure may also be useful for other size ends. For example, a downgauged end of the 204, 206, or 209 size range may incorporate the disclosed geometry of a stepped panel outer edge 18, narrow countersink 16, parallel walls of the countersink 16, and angularly extending chuckwall which extends from below the panel height and joining the curl 14.

While the invention has been described with reference to preferred embodiments, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

We claim:

1. An end closure for a container, comprising:

a central panel wall having a product side and a public side and having a tab and a rivet;

a displaceable tear panel in the central panel wall at least substantially defined by a frangible score and a non-frangible hinge segment;

the tab being attached to the public side of the central panel wall by the rivet, at least a nose portion of the tab extending over a portion of the tear panel, a lift end of the tab being opposite the tab nose;

a central webbing of the tab between the nose and lift end, the webbing having a hinge region and a rivet island surrounding the rivet, the rivet island being at least partially surrounded by a void region to provide an exposed area of the central panel, a curvilinear bead in the central panel wall being located entirely in said exposed area.

2. The end closure of claim 1, wherein the bead is a deboss bead in the central panel wall protruding downward from the public side of the central panel.

3. The end closure of claim 1 or 2, wherein the nose of the tab has an asymmetric outer edge with a first portion and a second portion, the second portion of the tab nose extending further over the tear panel than the first portion of the nose.

4. The end closure of claim 1, wherein;

the bead has an arcuate length partially surrounding the rivet, opposing ends of the bead being approximately equal distance from the score.

5. An end closure for a container, comprising:

a central panel wall having a product side and a public side and having a tab and a rivet;

a displaceable tear panel in the central panel wall at least substantially defined by a frangible score and a non-frangible hinge segment;

the tab being attached to the public side of the central panel wall by the rivet, at least a nose portion of the tab extending over a portion of the tear panel, a lift end of the tab being opposite the tab nose;

a central webbing of the tab between the nose and lift end, the webbing having a hinge region and a rivet island surrounding the rivet, the rivet island being at least partially surrounded by a void region to provide an exposed area of the central panel, a bead in the central panel wall being located entirely in said exposed area, wherein the void region is a curvilinear opening and the bead has an arcuate length partially surrounding the rivet at generally equal distance from the rivet along the extent of the bead length.

6. The end closure of claim 5, wherein;

the arcuate length of the bead is comprised of a semi-circular portion with a first leg at one end of the bead and a second leg at an end opposite said first end, the first leg and second leg being spaced at substantially equal distance from the score of the tear panel.

7. An end closure for a container, comprising:

a central panel wall having a product side and a public side and having a tab and a rivet;

the tab being attached to the public side of the central panel wall by the rivet, at least a nose portion of the tab extending over a portion of a displaceable tear panel in the tear panel wall, a lift end of the tab being opposite the tab nose;

a central webbing of the tab between the nose and lift end, the webbing having a hinge region and a rivet island surrounding the rivet, the rivet island being at least partially surrounded by a void region to provide an exposed area of the central panel, a deboss bead being formed in the exposed area of the central panel wall;

the displaceable tear panel in the central panel wall being defined by a frangible score and a non-frangible hinge segment, the tear panel having a generally round geometry with a width greater than the nose of the tab;

the score having a first scoreline segment with a vent region positioned at least partially under the nose of the tab and extending to a region immediately adjacent the tab nose, a second curvilinear scoreline segment extending from the first segment toward the panel outer edge portion to a third scoreline segment having a curvilinear transition zone and extending to a fourth scoreline segment of the remaining scoreline;

the nose of the tab having a generally asymmetric shaped outer edge with a first portion and a second portion, the second portion extending further over the tear panel toward the curvilinear transition zone than the first portion of the nose.

8. An end closure for a container, comprising:

a central panel wall defining a planar body having a product side and a public side with a tab and a rivet on said public side;

a displaceable tear panel in the central panel wall defined by a frangible score and a non-frangible hinge segment;

the tab being attached to the public side of the central panel wall by the rivet, at least a nose portion of the tab extending over a portion of the tear panel and a lift end of the tab being opposite the tab nose, the tab having an elongated body with a central longitudinal axis through the length of the elongated body;

a central webbing of the tab between the nose portion and the lift end, the central webbing having a rivet island at least partially surrounded by a void region and having a hinge region adapted to bend at a hinge line when a lifting force is applied to the lift end of the tab to provide a leverage force by the nose against the tear panel, the hinge line intersecting the central longitudinal axis of the tab at an oblique angle.

9. The end closure of claim 8, wherein the void region of the central webbing having a curvilinear geometry with a first end and a second end, the hinge line being defined by a linear segment between the first and second ends.

10. The end closure of claim 8, wherein a curvilinear deboss bead being formed in the central panel at least partially surrounding the rivet island.

11. An end closure for a container, comprising:

a central panel wall having a product side and a public side with a tab and a rivet, the central panel wall generally defining a first plane;

a displaceable tear panel in the central panel wall defined by a frangible score and a non-frangible hinge segment;

the tab attached to the public side of the central panel wall by the rivet, at least a nose portion of the tab extending over a portion of the tear panel, a lift end of the tab being opposite the tab nose, the tab having an elongated body between the nose and the lift end with a central longitudinal axis;

a central webbing of the tab between the nose and lift end, the webbing having a rivet island defined by a curvilinear opening and a hinge line passing between a first end and a second end of the curvilinear opening, the hinge line being at an oblique angle relative to the central longitudinal axis of the tab.

12. The end closure of claim 11, wherein a curvilinear deboss bead being formed in the central panel at least partially surrounding the rivet island.

13. The end closure of claim 11, wherein the hinge line being defined by a linear segment between the first and second ends of the void region.

14. The end closure of claim 11, wherein the tab being adapted to rotate about the hinge line when a lifting force is applied to the lift end, the hinge line being adapted to direct a linear path of rotation of the tab at a compound angle relative to the first plane defined by the panel wall.

15. The end closure of claim 14, wherein the linear path of the tab rotation generally following an angular displacement of the tear panel.

16. An end closure for a container, comprising:

a central panel wall having a product side and a public side with a tab and a rivet;

the tab being attached to the public side of the central panel wall by the rivet, at least a nose portion of the tab extending over a portion of a displaceable tear panel in the tear panel wall, a lift end of the tab being opposite the tab nose;

a central webbing of the tab between the nose and lift end, the webbing having a hinge region and a rivet island surrounding the rivet, the rivet island being at least partially surrounded by a void region to provide an exposed area of the central panel;

the displaceable tear panel in the central panel wall being defined by a frangible score and a non-frangible hinge segment;

the score having a first scoreline segment with a vent region positioned at least partially under the nose of the tab and extending to a region immediately adjacent the tab nose, a second curvilinear scoreline segment extending from the first segment toward the panel outer edge portion to a third scoreline segment having a curvilinear transition zone and extending to a fourth scoreline segment of the remaining scoreline;

the nose of the tab having an asymmetrical thickness with a first portion and a thickened second portion, the thickened second portion being adjacent the second scoreline segment.

17. The end closure of claim 16, wherein the tear panel having a generally round geometry having a width substantially wider than the nose of the tab.

18. The end closure of claim 16, further comprising a deboss bead formed in the exposed area of the central panel wall.

19. An end closure for a container, comprising:

a central panel wall having a product side and a public side with a tab and a rivet;

the tab being attached to the public side of the central panel wall by the rivet, at least a nose portion of the tab extending over a portion of a displaceable tear panel in the tear panel wall, a lift end of the tab being opposite the tab nose;

a central webbing of the tab between the nose and lift end, the webbing having a hinge region and a rivet island surrounding the rivet, the rivet island being at least partially surrounded by a void region to provide an exposed area of the central panel;

the displaceable tear panel in the central panel wall being defined by a frangible score and a non-frangible hinge segment, the tear panel having a generally round geometry with a width greater than the nose of the tab;

the score having a first scoreline segment with a vent region positioned at least partially under the nose of the tab and extending to a region immediately adjacent the tab nose, a second curvilinear scoreline segment extending from the first segment toward the panel outer edge portion to a third scoreline segment having a curvilinear transition zone and extending to a fourth scoreline segment of the remaining scoreline;

a bead segment positioned under a side portion of the tab nose adjacent the second segment of the score, the bead segment having an upper surface for contact with the tab nose and being adapted to direct an opening force toward the transition zone when an opening force is applied by lifting the tab from the lift end such that the nose is applied against the tear panel.

20. The end closure of claim 19, wherein a deboss bead being formed in the exposed area of the central panel wall at least partially surrounding the rivet island.

21. An end closure for a container, comprising:

a central panel wall having a product side and a public side with a tab and a rivet;

a displaceable tear panel in the central panel wall at least substantially defined by a frangible score and a non-frangible hinge segment;

the tab being attached to the public side of the central panel wall by the rivet, at least a nose portion of the tab extending over a portion of the tear panel, a lift end of the tab being opposite the tab nose;

a central webbing of the tab between the nose and lift end, the webbing having a hinge region and a rivet island surrounding the rivet, the rivet island being at least partially surrounded by a void region to provide an exposed area of the central panel;

the panel wall having a sloping segment having a first bend leading to a first sloping edge of the tear panel adjacent the score, a second sloped edge on the panel wall outside the tear panel being immediately adjacent the score and leading away from the score to a second bend, the frangible score being within said sloping segment.

22. The end closure of claim 21, wherein the first bend is an upward bend and the tear panel is positioned slightly below the score.

23. The end closure of claim 21, wherein a deboss bead being formed in the exposed area of the central panel wall at least partially surrounding the rivet island.

24. An end closure for a container, comprising:

a central panel wall generally defining a first plane with a panel height and having a product side and a public side with a tab and a rivet, the panel having an outer circumferential edge having a stepped profile with a first bend and a second bend joined by a generally vertical transition segment;

a displaceable tear panel in the central panel wall at least substantially defined by a frangible score and a non-frangible hinge segment;

the tab being attached to the public side of the central panel wall by the rivet, at least a nose portion of the tab extending over a portion of the tear panel, a lift end of the tab being opposite the tab nose;

a central webbing of the tab between the nose and lift end, the webbing having a hinge region and a rivet island surrounding the rivet, the rivet island being at least partially surrounded by a void region to provide an exposed area of the central panel;

a circumferential countersink radially outward of the outer edge, having an inner wall and an outer wall joined by a curved segment having an inner radius of curvature, said inner wall being substantially parallel with said outer wall;

a chuckwall angularly extending from the outer wall to join a seaming curl.

25. The end closure of claim 24, wherein the second bend is positioned at a height approximately half the panel height and the chuckwall extends from the outer wall at an angle in the range of 10° to 15°.

26. The end closure of claim 24, wherein a deboss bead being formed in the exposed area of the central panel wall at least partially surrounding the rivet island.

* * * * *